United States Patent [19]

Takahashi et al.

[11] Patent Number: 4,802,778

[45] Date of Patent: Feb. 7, 1989

[54] CARRIAGE DRIVE CONTROL DEVICE IN A PRINTING DEVICE

[75] Inventors: Kiyoshi Takahashi; Hisaki Okada, both of Aichi, Japan

[73] Assignee: Brother Kogyo Kabushiki Kaisha, Aichi, Japan

[21] Appl. No.: 849,396

[22] Filed: Apr. 8, 1986

[30] Foreign Application Priority Data

Apr. 9, 1985 [JP] Japan ..... 60-74678

[51] Int. Cl.[4] ..... B41O 13/10

[52] U.S. Cl. ..... 400/624; 400/639.1; 400/642; 400/706; 400/902

[58] Field of Search ..... 400/320, 624, 625, 629, 400/637.1, 639.1, 639.2, 640, 674, 706, 707.5, 708, 902, 642

[56] References Cited

U.S. PATENT DOCUMENTS

| | | | |
|---|---|---|---|
| 4,085,837 | 4/1978 | Takano et al. | 400/902 X |
| 4,326,815 | 4/1982 | Kapp | 400/625 |
| 4,486,108 | 12/1984 | Tanaka | 400/639.1 |
| 4,498,795 | 2/1985 | Tatara | 400/639.1 X |
| 4,500,219 | 2/1985 | Lange et al. | 400/639.1 X |
| 4,525,089 | 6/1985 | Falconierl | 400/639.1 |
| 4,569,611 | 2/1986 | Watanabe et al. | 400/624 |

FOREIGN PATENT DOCUMENTS

| | | | |
|---|---|---|---|
| 0144983 | 11/1981 | Japan | 400/639.1 |
| 0084782 | 5/1983 | Japan | 400/708 |
| 0194879 | 11/1984 | Japan | 400/707.5 |
| 2093244 | 8/1982 | United Kingdom | 400/707.5 |

*Primary Examiner*—Ernest T. Wright, Jr.
*Attorney, Agent, or Firm*—Finnegan, Henderson, Farabow, Garrett & Dunner

[57] ABSTRACT

A carriage drive control device to enable printing on a printing sheet from the leading edge thereof. A carriage drive control device repositions a carriage supporting a print head and a paper guide member at the midpoint of a printing line prior to each advance of the printing sheet as long as the leading edge of the printing sheet has been advanced beyond the printing line by a distance less than a predetermined distance.

5 Claims, 5 Drawing Sheets

CARRIAGE DRIVE CONTROL DEVICE IN A PRINTING DEVICE

FIELD OF THE INVENTION

This invention relates to printing devices such as printers and typewriters, and more particularly to a carriage drive control device for feeding a printing sheet line by line.

BACKGROUND OF THE INVENTION

A conventional printing device, such as a printer or a typewriter, as shown in FIG. 5, comprises a platen 1 adapted to support a printing sheet 3 fed from a sheet supplying device 2, a printing head 4 for printing on the printing sheet 3 while moving in the axial direction of the platen 1, a paper guide member 5 for supporting the printing head 4 and guiding the printing sheet 3, and a carriage 33 for supporting the paper guide member 5.

The printing device further comprises a paper bail 6 above the paper guide member 5. The paper bail 6 is for winding the printing sheet 3 on the platen 1.

In printing operations performed with such a printing device, the part of the printing sheet 3 that is located between the retaining position of the paper bail 6 and the printing position cannot be used for printing. It may be possible to try to print on the very beginning of the printing sheet 3; however, it would be impossible to feed the printing sheet 3 smoothly because the sheet 3 would not be retained by the paper bail 6.

OBJECTS AND SUMMARY OF THE INVENTION

An object of the present invention is to permit printing on the very top portion of a printing sheet by a typewriter or printer.

Another object of the present invention is a carriage drive control device for smoothly and stably advancing a printing sheet during printing operations.

Yet another object of the present invention is a carriage drive control device for controlling the advancement of a printing sheet in a printer, typewriter, or the like, such that printing may be done from the leading edge of the sheet.

These and other objects are accomplished by a carriage drive control device comprising means for supplying a printing sheet having a leading edge, a rotatable platen for receiving and supporting the printing sheet supplied by the supplying means and for advancing the printing sheet upon rotation of the platen, a print head, a carriage for supporting the print head for bidirectional movement along a printing line parallel to the platen, a paper guide member mounted on the carriage proximate the print head to confront the platen, driving means for selectively reciprocating the carriage along the printing line, means for determining whether the leading edge of the printing sheet has been advanced beyond the printing line by a predetermined distance, and drive control means for controlling and driving the carriage to position the print head at a predetermined location in the printing line prior to rotation of the platen to advance the printing sheet if the leading edge of the printing sheet has been advanced by a distance less than the predetermined distance.

BRIEF DESCRIPTION OF THE DRAWINGS

The manner by which these and other objects, features and advantages of the present invention are attained will become fully apparent from the following detailed description when it is considered in view of the drawings, wherein.

DETAILED DESCRIPTION

A preferred embodiment of the present invention will be described with reference to the accompanying drawings.

Figure 1:
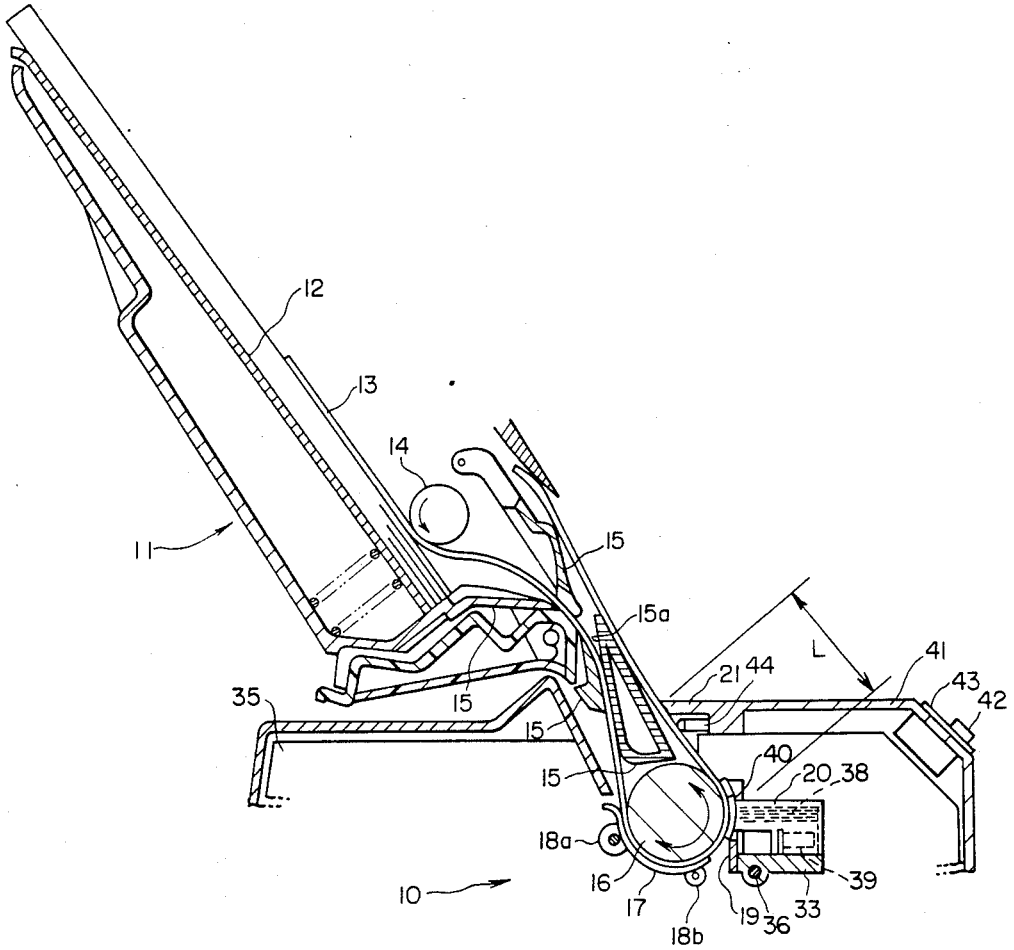
FIG. 1 is a sectional side view of a printing device that employs the carriage drive control device of the present invention.
Figure 2:
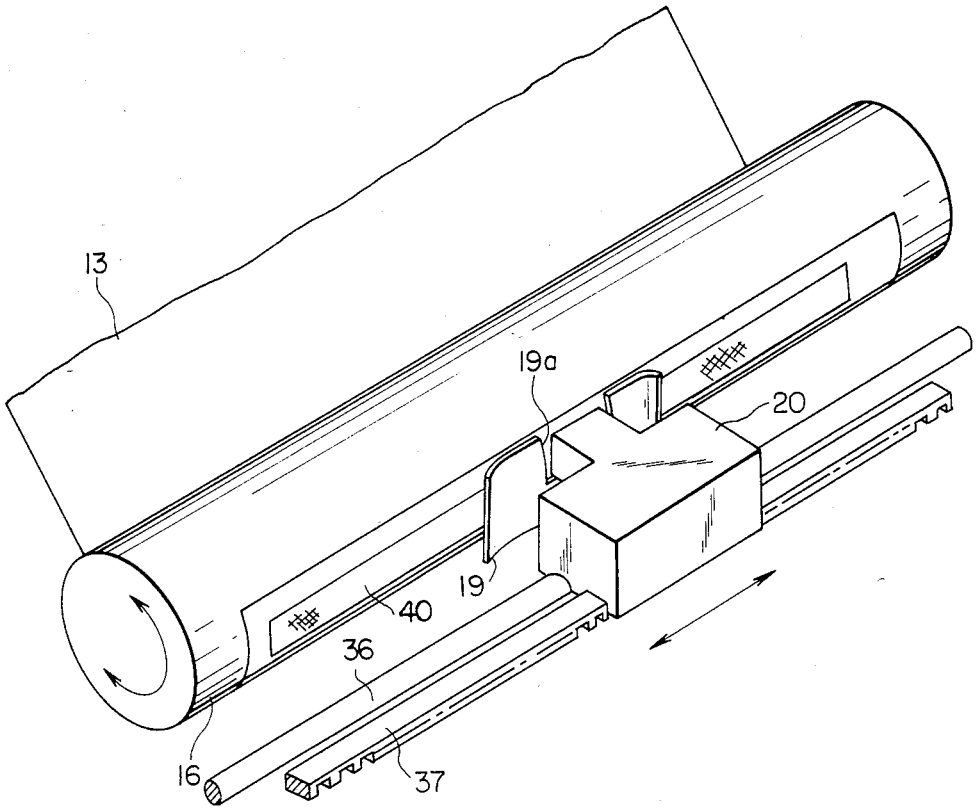
FIG. 2 is a perspective view showing the essential components of a printing device that employs the carriage drive control device of the present invention.

First, a printing device with an automatic sheet supplying device will be described with reference to FIGS. 1 and 2. The automatic sheet supplying device 11 is mounted on the printing device 10. In the automatic sheet supplying device 11, a sheet supplying roller 14 delivers printing sheets 13 from a sheet tray 12 one at a time, and a printing sheet 13 thus delivered is automatically conveyed to the platen 16 of the printing device 10 through a guide groove **15*a* formed by a plurality of guide members 15**.

The platen 16 is rotatably supported by the frame 35 of the printing device 10. A platen driving motor 28 (FIG. 3) is operatively coupled to the platen 16. As the platen driving motor 28 rotates in the forward or reverse direction, the platen 16 is correspondingly rotated in the forward or reverse direction to feed the printing sheet 13 supported thereby. As the platen driving motor 28 rotates in the forward direction, the platen 16 is rotated in the forward direction (counterclockwise in FIG. 1) to feed the printing sheet 13 in the forward direction. A guide plate 17 and a pair of sheet retaining rollers 18a and 18b are provided along the periphery of the platen 16. The printing sheet 13 delivered from the automatic sheet supplying device 11 is wound on the platen 16 by the guide plate 17 and the rollers 18a and 18b.

In front of the platen 16 (or to the right of the platen 16 in FIG. 1), a carriage 33 is slidably mounted on a guide rod 36 that is provided in parallel with the platen 16. A paper guide member 19 and a printing head 20 are mounted on the carriage 33 in such a manner as to confront the platen 16. A carriage driving motor 31, such as a step motor or DC motor (FIG. 3) is operatively coupled to the carriage 33 through a timing belt 37. As the carriage driving motor 31 rotates in the forward or reverse direction, the carriage 33 is correspondingly moved along the printing line in the forward or reverse directions.

In the printing head 20, a plurality of printing wires 38 are selectively operated by an electromagnet unit 39 to print characters or the like in a dot matrix form on the printing sheet 13 with the aid of a printing ribbon 40. The paper guide member 19, as shown in FIG. 2, has a predetermined width in the direction of the printing line and is centered about a cut 19a therein through which a printing operation is carried out by the printing head 20. The paper guide member 19 holds and supports the part of the printing sheet 13 on which characters or the like are to be printed.

A paper guide 21, formed at the rear end of a cover 41 that is set above the printing section, is provided above the platen 16. The printing sheet 13 delivered from the platen 16 is guided to go out of the printing device 10 by the paper guide 21. That is, after the front edge of the printing sheet 13 has reached the paper guide 21, the printing sheet 13 is stably fed by the paper guide 21. In the preferred embodiment, the distance of movement of the printing sheet 13 between the position where the printing sheet 13 is supported by the paper guide member 19 in front of the printing head 20, and the paper guide 21 is three inches. This distance is referred to as "a reference distance L."

Figure 3:
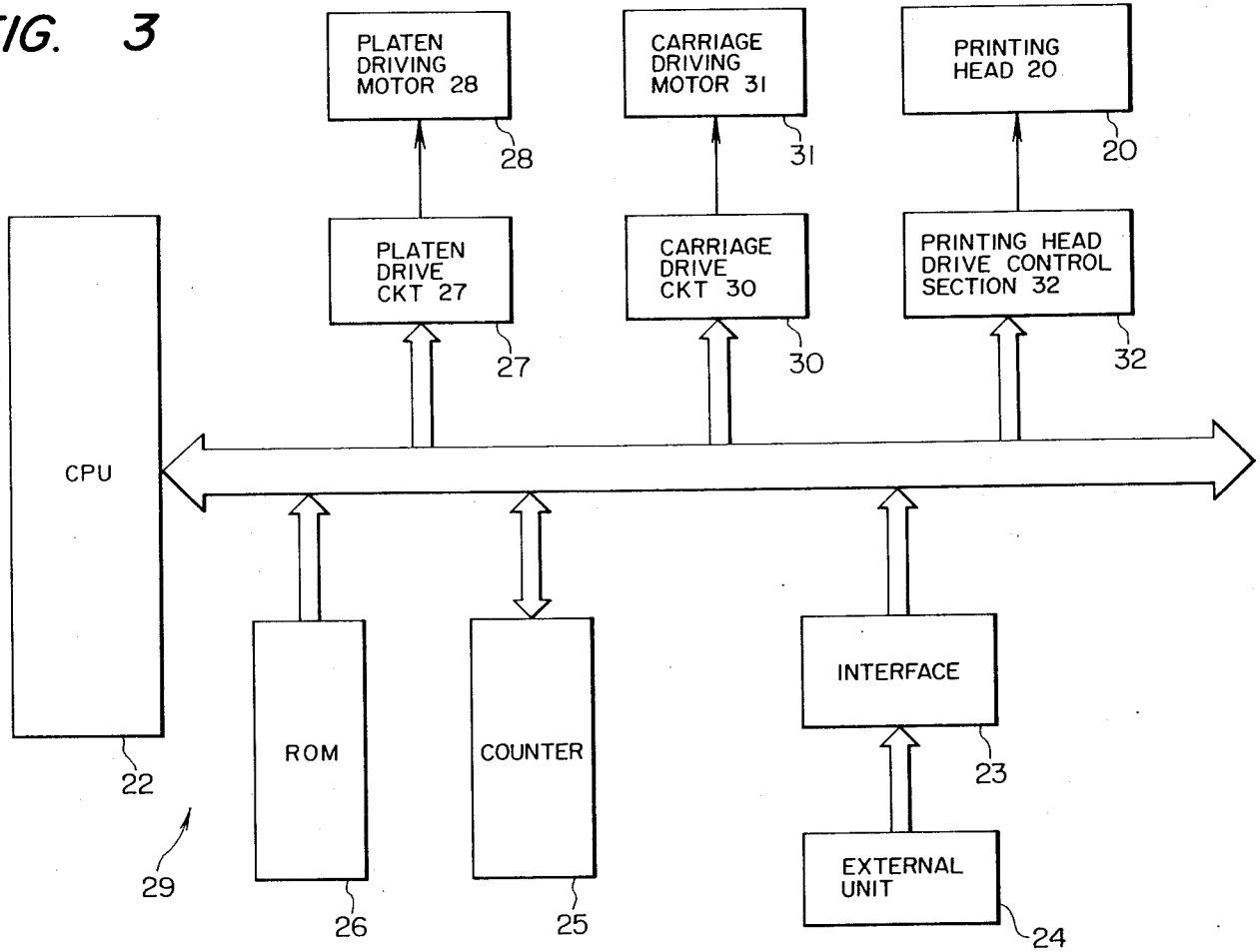
FIG. 3 is a block diagram of a circuit used in the carriage drive control device of the present invention.

The electrical arrangement of the printing device 10 thus constructed will be described with reference to FIG. 3.

A drive control means, namely, a microcomputer 29 comprises a central processing unit (CPU) 22 and a read-only memory (ROM) 26 in which a control program has been stored. The CPU 22 is connected through an interface 23 to an external unit 24 for inputting printing character data, etc., and it is further connected to a counter 25. Whenever the platen 16 is turned to feed the printing sheet 13 by one printing line, the CPU 22 applies a count signal to the counter 25. The counter 25 counts the count signals thus applied.

The CPU 22 is further connected to a platen drive circuit 27 that is connected to the platen driving motor 28. The platen drive circuit 27, the platen driving motor 28, and the platen 16 form a sheet supplying means.

The CPU 22 supplies a control signal to the platen drive circuit 27 to rotate the platen driving motor 28 in the forward or reverse direction. The platen 16 is turned through a given angle by the motor 28 to feed the printing sheet 13. That is, in association with the sheet supplying operation of the automatic sheet supplying device 11, the CPU 22 causes the platen driving motor 28, which is driven by the platen drive circuit 27, to turn the platen 16 in the forward direction until the front edge of the printing sheet 13 reaches the position where its leading edge confronts the printing head 20 as shown in FIG. 2. This places the printing sheet 13 in the start position complying with the aforementioned reference distance L.

Under this condition, the CPU 22 causes the printing head 20 to start the printing operation. Whenever a line printing operation is accomplished, the CPU 22 applies the control signal to the platen drive circuit 27 to rotate the platen driving motor 28 in the forward direction and to feed the print sheet 13 by one line. The printing sheet 13 is advanced by 1/6 inch for every one-line-feeding operation. Therefore, 1/6 of the count value of the counter 25 is the distance between the aforementioned start position and the leading edge of the printing sheet 13.

The CPU 22 is further connected to a carriage drive circuit 30 that is connected to the carriage driving motor 31. The CPU 22 applies a control signal to the carriage drive circuit 30 to move the carriage 33 at a constant speed. During the line-feeding operations carried out until the leading edge of the printing sheet 13 reaches the paper guide 21, the carriage 33 is moved to the center of the printing line prior to each line advance.

The CPU 22 is further connected to a printing head drive control section 32 that is connected to the printing head 20. According to printing data inputted by the external unit 24, the CPU 22 supplies a control signal to the printing head drive control section 32 so that the printing wires 38 of the printing head 20 are selectively operated to print characters in dot matrix form on the printing sheet 13.

Figure 4:
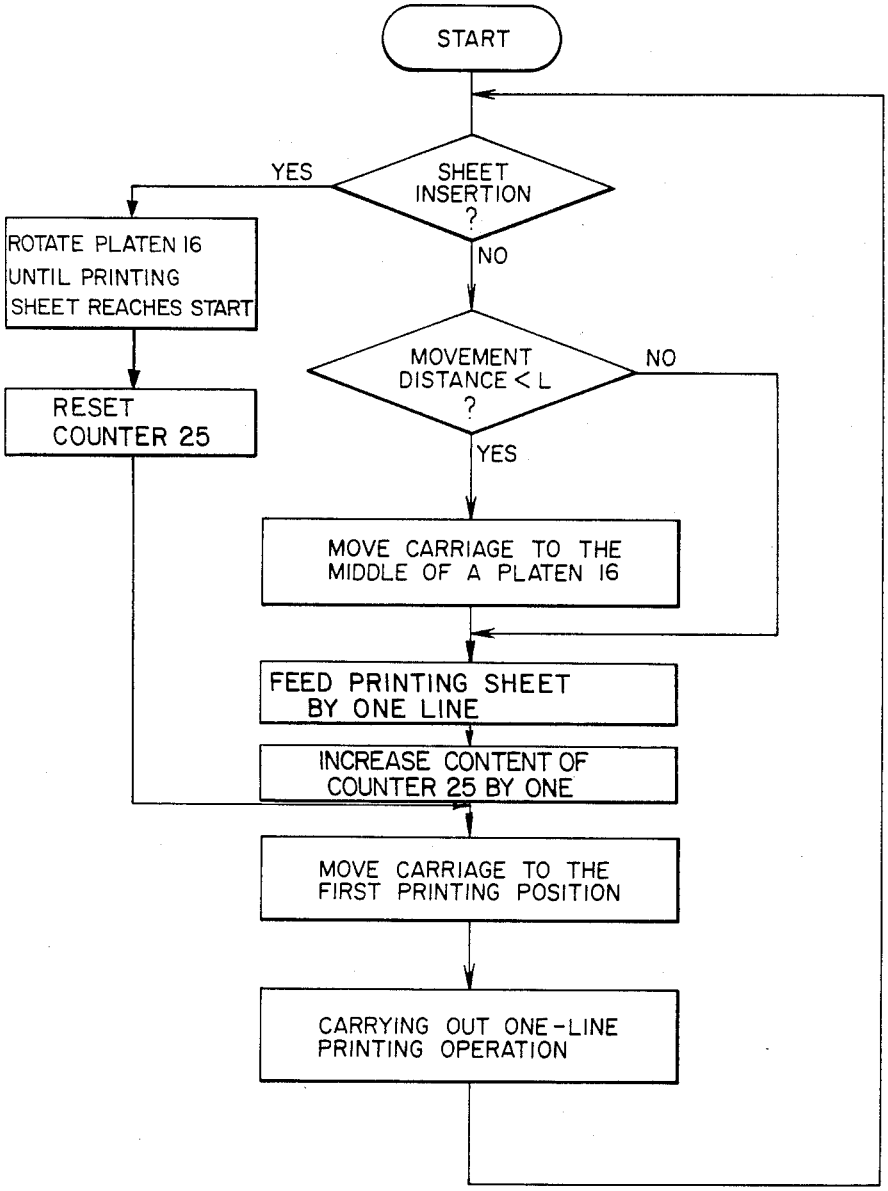
FIG. 4 is a flowchart of the operation of the carriage drive control device of the present invention.
Figure 5:
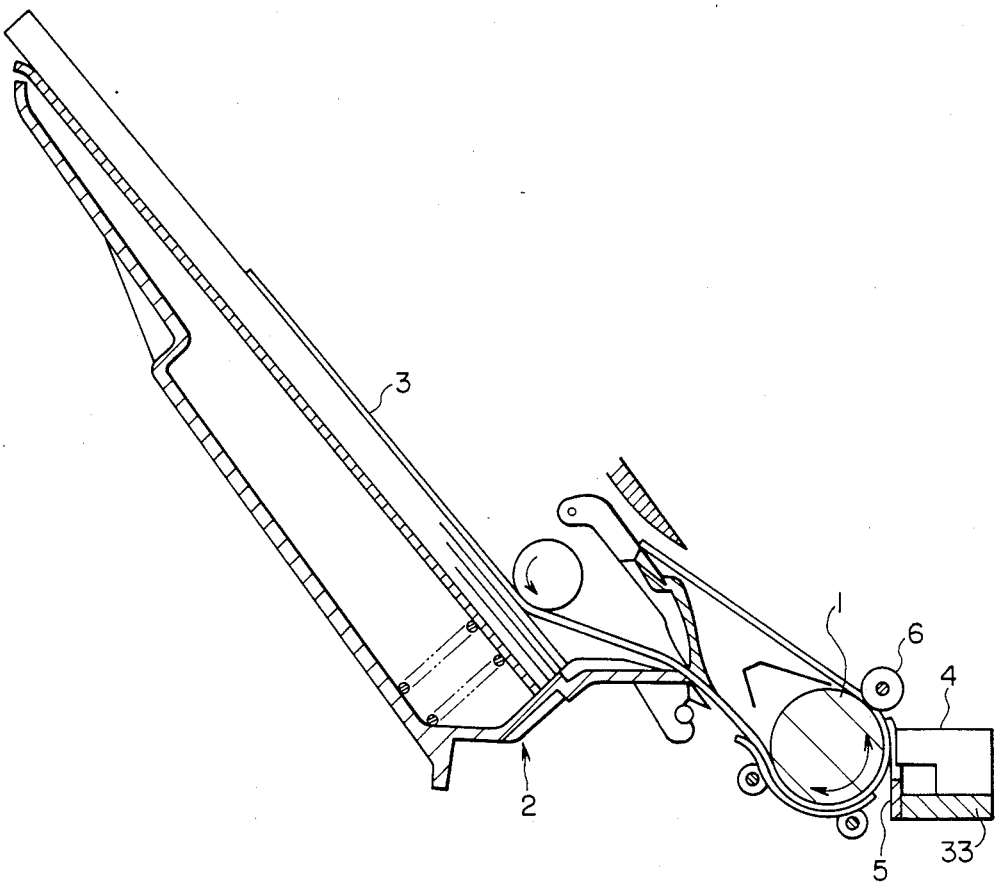
FIG. 5 PRIOR ART
FIG. 5 is a sectional side view of a conventional printing device.

The movement of the carriage 33 in the line feeding operation will be described with reference to FIGS. 3 and 4. Upon operation of a sheet insertion button 42 on an operating panel 43, the CPU 22 causes the automatic sheet supplying device 11 to start its operation, and applies the control signal to the platen drive circuit 27 to rotate the platen drive motor 28 in the forward direction and to rotate the platen 16 in the forward direction until the leading edge of the printing sheet 13 reaches the start position where it confronts the printing head 20. At the same time, the CPU 22 drives the carriage driving motor 31 so that the carriage 33 is moved to the middle of the platen 16 and the paper guide member 19 supports the printing sheet 13 along its vertically central line. Under this condition, the CPU 22 resets the content of the counter 25.

The carriage driving motor 31 is rotated through the carriage drive circuit 30 by the CPU 22 according to the character data inputted by the external unit 24, so that the carriage 33 is moved to the first printing position in the printing line. Thereafter, while the carriage 33 is moved along the printing line at a constant speed, print operations are carried out by the printing head 20 with the aid of the printing head drive control section 32. When a line has been printed in this way, the CPU 22 calculates the distance between the start position and the front edge of the printing sheet 13 according to the content of the counter 25, and detects that the content of the counter 25 is still smaller than the reference distance L. Accordingly, the carriage 33 is moved to the center of the printing line. Under this condition, the CPU 22 applies the control signal to the platen drive circuit 27 to turn the platen driving motor 28 to feed the printing sheet 13 by one line. That is, the printing sheet 13 is advanced by 1/6 inch. In this case, since the paper guide member 19 supports the printing sheet 13 along its vertically central line, the printing sheet 13 can be stably moved in the line feeding direction. In this operation, the CPU 22 supplies the count signal to the counter 25 according to the drive control signal applied to the platen drive circuit 27, and, therefore, the content of the counter 25 is increased by one (1).

Continuing in this manner, the CPU 22 operates to feed the printing sheet 13 by 1/6 inch for each line of printing, and causes the counter 25 to count the count signal that is outputted by the platen drive circuit 27 upon every line feeding operation. That is, the CPU 22 operates to feed the printing sheet 13 by 1/6 inch for every line feeding operation. When the line feeding operation is repeated 18 times; i.e., when the counter 25 counts "18" and the printing sheet 13 has been advanced by 3 inches from the start position of the reference distance L so that the front edge of the printing sheet 13 reaches the paper guide 21, the printing sheet 13 is fed at the position where the last character in the line has been printed, instead of being fed after the carriage 33 is moved to the center of the print line as was described before. That is, after the front edge of the printing sheet 13 has reached the paper guide 21, the guide 21 supports the printing sheet 13, and therefore, it is unnecessary to cause the paper guide member 19 to hold the printing sheet 13.

As is apparent from the above description, in the embodiment of the present invention, the paper bail 6 that was heretofore required by a printing device 10 is eliminated, and the paper guide member 19 on the carriage 33 supports the printing sheet 13 until the front edge of the printing sheet 13 reaches the paper guide 21. Therefore, with the printing device 10 according to the present invention, characters can be printed from the top of a printing sheet 13. In this case, the paper guide member 19 holds the printing sheet 13 at the center of the print line and the printing sheet 13 can be fed straightly and smoothly.

As is apparent from the above description, the paper bail 6, which is an essential component for a conventional printing device, is eliminated according to the present invention so that the printing of characters can be started from the top of a printing sheet 13, and the printing sheet 13 can be smoothly and straightly fed.

The present invention is not limited to or by the above-described embodiment. That is, it will be obvious to those skilled in the art that various changes and modification may be made without departing from the scope and spirit of the invention. For instance, in the above-described embodiment, when the leading edge of the printing sheet 13 reaches the paper guide 21, the carriage 33 is no longer moved to the center of the print line during the line feeding operation. The carriage drive control device 29 may be so modified that, even after the leading edge of the print sheet 13 has reached the paper guide 21, the carriage 33 will be moved to the center of the printing line before a line feeding operation is performed.

In the above-described embodiment, the fact that the leading edge of the printing sheet 13 has reached the paper guide 21 is detected by counting the number of line feeding operations; however, it may be detected by a sensor 44 or the like which can detect the arrival of the printing sheet 13 at the paper guide 21.

In the above-described embodiment, the automatic sheet supplying device 11 is employed to deliver the printing sheet 13 to the platen 16; however, the printing device 10 may be so designed that the printing sheet 13 is manually inserted therein.

What is claimed is:

1. A carraige drive control device comprising:

means for supplying a printing sheet having a leading edge;

a rotatable platen means for receiving and supporting said printing sheet supplied by said supplying means and for advancing said printing sheet upon rotation of said rotatable platen means;

a print head;

a carriage means for supporting said print head for bidirectional movement along a printing line parallel to said rotatable platen means;

a paper guide member mounted on said carriage means proximate said print head to confront said rotatable platen means;

a driving means for selectively reciprocating said carriage means along said printing line;

means for determining, upon the end of the printing operation for each line, whether said leading edge of said printing sheet has been advanced beyond said printing line by a predetermined distance; and drive control means for controlling said driving means and said carriage means to position said print head at a predetermined location in said printing line prior to rotation of said rotatable platen means to advance said printing sheet if said leading edge of said printing sheet has been advanced by a distance less than said predetermined distance.

2. A carriage drive control device according to claim 1, wherein said determining means comprises:

a counter; and means for setting said counter to zero upon said leading edge reaching said printing line, for incrementing said counter upon every advance of said printing sheet by said rotatable platen means and for comparing said count of said counter to a value representing the number of advances of said rotatable plane means necessary to advance said leading edge of said printing sheet beyond said printing line by said predetermined distance.

3. A carriage drive control device according to claim 2, wherein said setting, incrementing, and comparing means comprises:

a memory for storing a control program; and a processing unit for executing said control program.

4. A carriage drive control device according to claim 3, wherein said print head prints said printing sheet at a printing position aligned with said printing line, and wherein said paper guide member extends from said printing position in each direction along said printing line.

5. A carriage drive control device according to claim 4, wherein said predetermined location corresponds to the midpoint of said printing line.

* * * * *